US005123316A

United States Patent [19]

Niedermaier et al.

[11] Patent Number: 5,123,316

[45] Date of Patent: Jun. 23, 1992

[54] METHOD AND APPARATUS FOR THE REDUCTION OF PAPER WASTE

[75] Inventors: Arnold J. Niedermaier, Beindersheim; Karl H. Zeiler, Bobenheim-Roxheim, both of Fed. Rep. of Germany

[73] Assignee: Albert-Frankenthal Aktiengesellschaft, Frankenthal, Fed. Rep. of Germany

[21] Appl. No.: 596,033

[22] Filed: Oct. 11, 1990

[30] Foreign Application Priority Data

Oct. 26, 1989 [DE] Fed. Rep. of Germany ..... 3935614

[51] Int. Cl.[5] ..... B23Q 15/00; B65H 23/00

[52] U.S. Cl. ..... 83/29; 83/47; 83/74; 83/367; 83/408

[58] Field of Search ..... 83/29, 47, 72, 74, 75, 83/367, 408

[56] References Cited

U.S. PATENT DOCUMENTS 2,214,593 9/1940 Mustin et al. ..... 83/72 X
3,083,602 4/1963 Obenshain ..... 83/75
3,276,647 10/1966 Lewis, Jr. et al. ..... 83/74 X
3,407,690 10/1968 Stanley ..... 83/47

FOREIGN PATENT DOCUMENTS 2211598 9/1973 Fed. Rep. of Germany .
3515626 10/1985 Fed. Rep. of Germany .
8700513 6/1987 Fed. Rep. of Germany .
3811909 6/1989 Fed. Rep. of Germany .

*Primary Examiner*—Frank T. Yost
*Assistant Examiner*—Eugenia A. Jones
*Attorney, Agent, or Firm*—Tullar & Cooper Jones

[57] ABSTRACT

A method and apparatus for the reduction of paper waste in a web fed printing machine utilizes one or more cutting mark reading heads and a strip cutting register device to vary the path of travel of a stack of part web strips in accordance with deviations in tension of the part web strips from a nominal value. Elongation or reduction of the length of the path of strip travel is used to properly register the strip stacks with respect to a strip cross-cutting device.

7 Claims, 3 Drawing Sheets

METHOD AND APPARATUS FOR THE REDUCTION OF PAPER WASTE

FIELD OF THE INVENTION

The present invention is directed generally to a method and apparatus for the reduction of paper waste. More particularly, the present invention is directed to a method and apparatus for the reduction of paper waste in a web fed printing machine. Most specifically, the present invention is directed to a method and apparatus for the reduction of paper waste in a web fed printing machine through the control of the tension of the web to thereby limit cutting register deviations. A web of paper is printed and is then slit into a plurality of strips that are laid on top of each other. The tension of these stacks of traveling strips is controlled so that the strips arrive at a strip cross cutting device in proper registry. Each running stack of strips passes over a shiftable strip register roller which is shiftable to properly tension the strip so that proper strip registry will be maintained.

DESCRIPTION OF THE PRIOR ART

It is generally well known in the field of printing using web-fed printing machines that paper web tension fluctuations can and do lead to cutting register variations. If these cutting register problems are of a sufficient magnitude, the printed strip will be so far out of registry that it will be severed in an unacceptable location, such as in the printed field, and must be discarded. These cutting register fluctuations must not exceed a predetermined limit so that there will not be a waste of printed paper.

Various printing steps are often apt to result in changes in the tension of the paper web. One of these is the changing of paper rolls. When changing the paper reel, a leading edge of a new paper web is adhered to the old paper web running into the web-fed rotary printing machine. During this procedure, the tension of the paper web decreases, especially because the upper windings of the new paper web are loose. Especially with rotogravure presses, in which very wide paper webs are often imprinted, the paper web is longitudinally cut up into numerous part paper webs or strips after the printing and before the printed web is run into the folder super-structure with its numerous turnbars and longitudinal register devices. These part paper webs are then combined into one or several paper strips. The paper strips are singly or jointly cut cross-wise into signatures and afterwards folded longitudinally and/or crosswise into products.

The printed part paper webs, which are running into the folder, first run over turnbars cushioned by compressed air. When the paper web tension decreases, such as occurs due to the procedure of changing the reels, then the compressed air of the turnbars forces the part paper web away from the turnbar, so that at least the distance which the part paper web has to cover from the longitudinal cutting device to the cross cutting rollers in the folding unit becomes longer and thus the cutting register will deviate from the adjusted nominal value. The drops in paper web tension during the changing of the reel, and the resulting changing of the cutting register, appear almost erratically and decrease according to how many windings there are, and how strongly loosened these windings are on the new reel. These cutting register changes have to be considered while keeping in mind that modern web-fed rotary printing machines often run at paper web speeds of 15 m/sec.

Various component parts of the apparatus for the reduction of paper waste in accordance with the present invention are generally known in the prior art. For example, a device for measuring and controlling the paper web tension in a web-fed rotary printing press is disclosed in German published non-examined patent application 22 11 598. Similarly, air-cushioned turnbars are shown in various publications, such as German utility model 87 00 513.1.

A paper web guiding arrangement which is useable to guide a paper web through a web-fed rotary printing machine is disclosed in the German non-examined patent application 35 15 626. In this device, a paper web is cut up into several paper strips with each of these strips comprising a plurality of collated ribbons overlying one another. Furthermore, the German non-examined patent application 35 15 626 discloses a device for adjusting the longitudinal register of the paper web strips and a device for the regulation of the cutting register in the folding unit.

The German non-examined patent application 38 11 90 shows a super-structure of a folder with numerous turnbars and longitudinal register rollers. These have the purpose of adjusting the cutting register of the numerous paper web strips.

While these various known prior art devices show several aspects of the present device, it is clear that a need exists for an assembly which will accomplish the reduction of paper waste by the proper regulation of paper web tension. The method and apparatus for the reduction of paper waste in accordance with the present invention accomplishes this result and is a significant improvement over the prior art devices.

SUMMARY OF THE INVENTION

It is an object of the present invention to provide a method and apparatus for the reduction of paper waste.

Another object of the present invention is to provide a method and apparatus for the reduction of paper waste in a web fed printing machine.

A further object of the present invention is to provide a method and apparatus for the reduction of paper waste in a web-fed printing machine due to errors in paper cutting registry.

Still another object of the present invention is to provide a method and apparatus for the reduction of paper waste by properly controlling paper web tension.

Even a further object of the present invention is to provide a method and apparatus for the reduction of paper waste by use of shiftable strip register rollers.

Yet another object of the present invention is to provide a method and apparatus for the reduction of paper waste using strip cutting mark reading heads.

As will be set forth in detail in the description of the preferred embodiment which is presented subsequently, the present invention utilizes a plurality of cutting mark read heads to sense the positions of stacks of strips of printed paper that have been cut from a printed web. The tension of these running stacks of strips is adjusted as each strip stack is directed to a strip cross cutting device and the resulting signatures are then folded. The tension of the strips is adjusted by using one or more shiftable strip register rollers. Each such roller is shiftable to increase or to decrease the tension on the corresponding stack of strips. This increase or decrease in tension insures that the strip stack is in proper register when it arrives at the strip cross cutting device.

In accordance with the present invention, the paper web tension is measured, such as from the introduction of the reel change and continues on before the web runs into the longitudinal cutting device and in response to these measured values, the path of travel of the paper ribbon is elongated or shortened by means of a paper-strip longitudinal register device. At the end of the reel changing procedure when the paper web tension has become normal again, the paper-strip longitudinal register device may reach a waiting position and may be turned off so that the cutting register will be controlled or regulated by means of the paper web longitudinal register device or the part paper web cutting register adjusting devices.

It is also within the contemplation of the possibilities of the present invention to continuously measure the cutting register of the strip by means of cutting register marks and cutting register reading-heads which read them as well as by means of an electronic strip-cutting register controlling and adjusting device, in order to find out clocked nominal value deviations, which arise synchronously to the strip-cross-cutting cylinder. As these nominal value deviations that arise are realized at an early stage because the dimension of the cutting register deviation can be predicted by means of the reading-heads or by suitable resistance strain gauges it is possible to operate the strip-cutting register device at an early stage in such a way that the cutting register error is as small as possible.

It is a particular advantage of the method and apparatus for the reduction of paper waste in accordance with the present invention that the waste of paper due to defective cutting register errors can be reduced without requiring the use of complicated devices. The present invention is useable with a number of press configurations and can be used with different kinds of strip cross cutting devices and folders. It is well suited for automatic control and thus does not require additional operators or time. The method and apparatus for the reduction of paper waste of the present invention will provide a noticeable cost savings and is a substantial advance in the art.

BRIEF DESCRIPTION OF THE DRAWINGS

While the novel features of the method and apparatus for the reduction of paper waste in accordance with the present invention are set forth with specificity in the appended claims, a full and complete understanding of the present invention may be had by referring to the detailed description of the preferred embodiment which is set forth subsequently, and is illustrated in the accompanying drawings, in which:

DESCRIPTION OF THE PREFERRED EMBODIMENT

Figure 1:
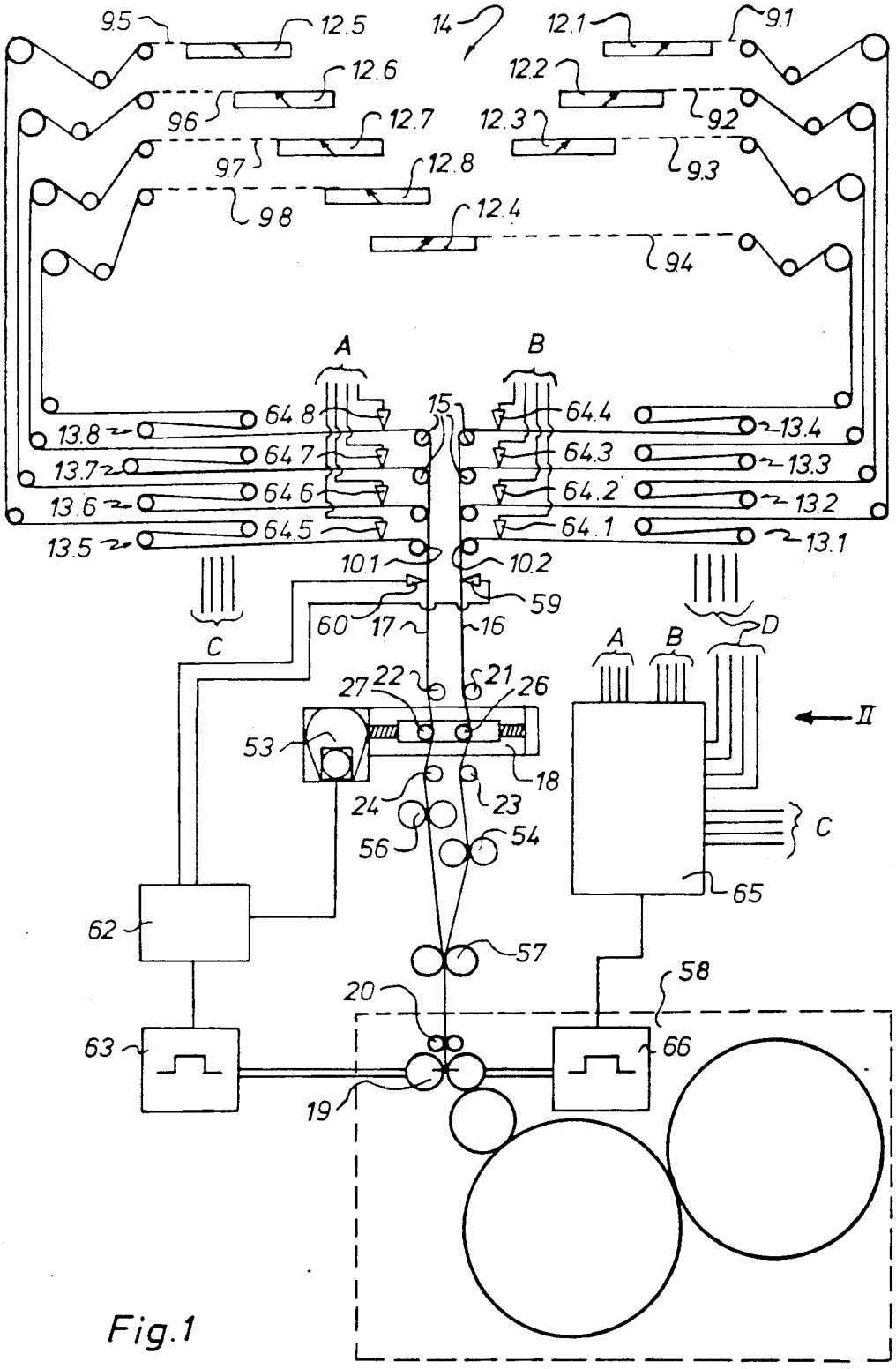
FIG. 1 is schematic side elevation view of a printed web folder and cross-cutting device and utilizing the apparatus for the reduction of paper waste in accordance with the present invention.
Figure 2:
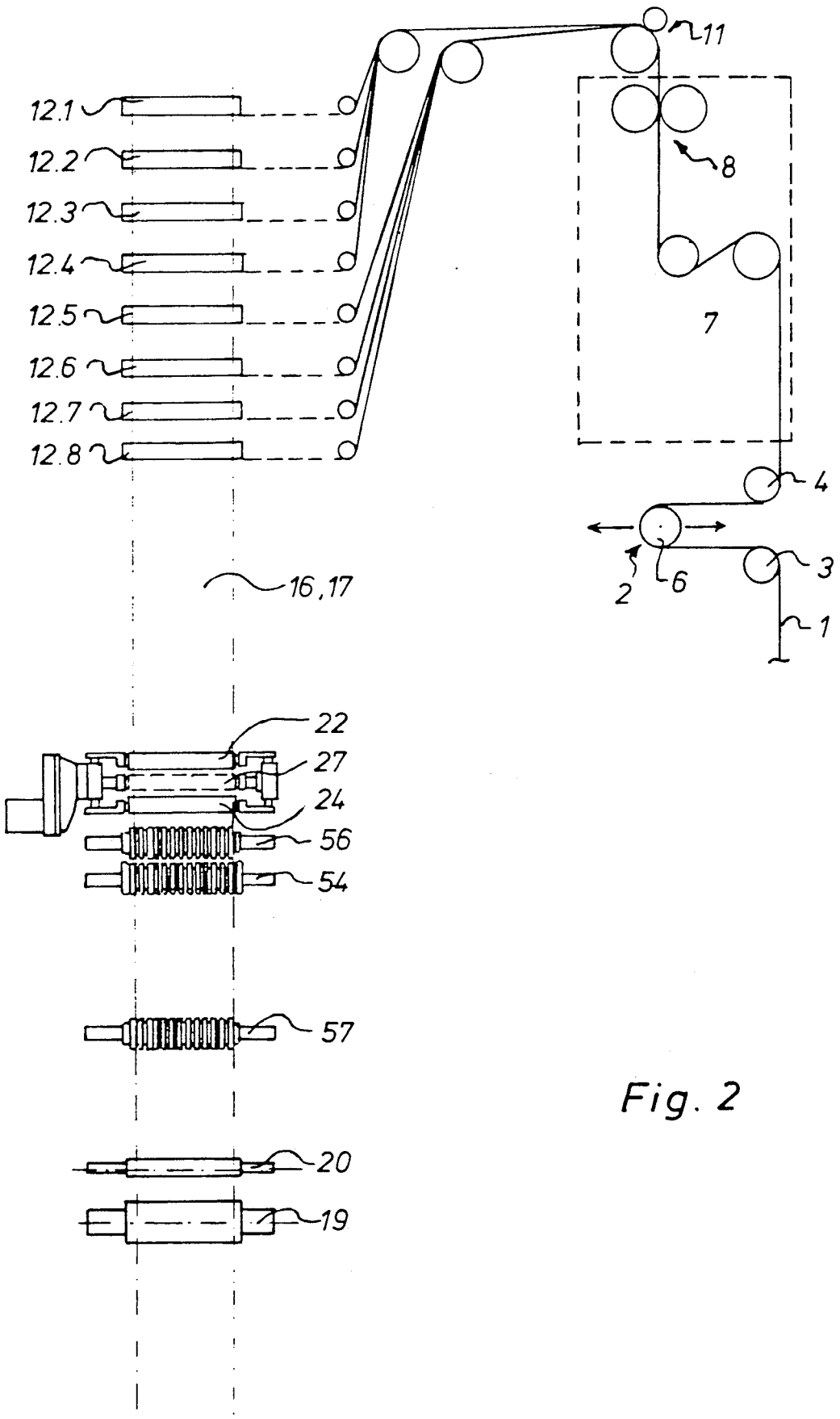
FIG. 2 is an elevation view of the apparatus of FIG. 1 and taken at the location and in the direction indicated at II in FIG. 1.

Referring initially to FIG. 2, a printed paper web 1 which is typically as wide as the forme cylinder and is thus a full-width printed web, runs from a web-fed rotary printing machine, such as a rotograve press, which is not shown, into a generally conventional main cutting register device 2. The main cutting register device 2 basically consists of two full-width paper guide rollers 3 and 4 that are solidly supported in side frames, as well as of a horizontally or vertically electromotively shiftable register roller 6. The electromotor for shifting the register roller 6 is connected with an electronic cutting register regulation assembly in a generally well known manner. As it leaves the main cutting register device 2, the paper web 1 reaches a slitting unit 8, via regulated pull rollers 7. In this slitting unit 8 the paper web 1 is longitudinally slit up into, for example, eight part paper webs 9.1 to 9.8, each of the same width. Beyond the slitting unit 8, the partial webs 9.1 to 9.8 run together through a second pull device 11 before they are singly guided in a known manner through a folder super-structure 14 via air-cushioned turnbars 12.1 to 12.8 which are assigned to them respectively, and then past web cutting register devices 13.1 to 13.8 and idler rollers 15. This above-described folder super-structure 14 may be seen more clearly by referring to FIG. 1.

As the various single partial web strips 9.1 to 9.8 pass over the various idler rollers 15, they are combined into one or two strips 16 and 17 which lie opposite of each other. The strip 16 consists, in the embodiment of the invention, of partial webs 9.1 to 9.4, and the strip 17 consists of partial webs 9.5 to 9.8 which are laid on each other. These two strips 16 and 17 run into a strip-cutting register device 18 in accordance with the present invention. This strip-cutting register device 18, as seen in the running direction of the strip, is arranged after the points of consolidation 10.1 and 10.2, where the part paper webs 9.1 to 9.8 finish forming the strips 16 and 17, and in front of a strip cross-cutting device 19.

Figure 3:
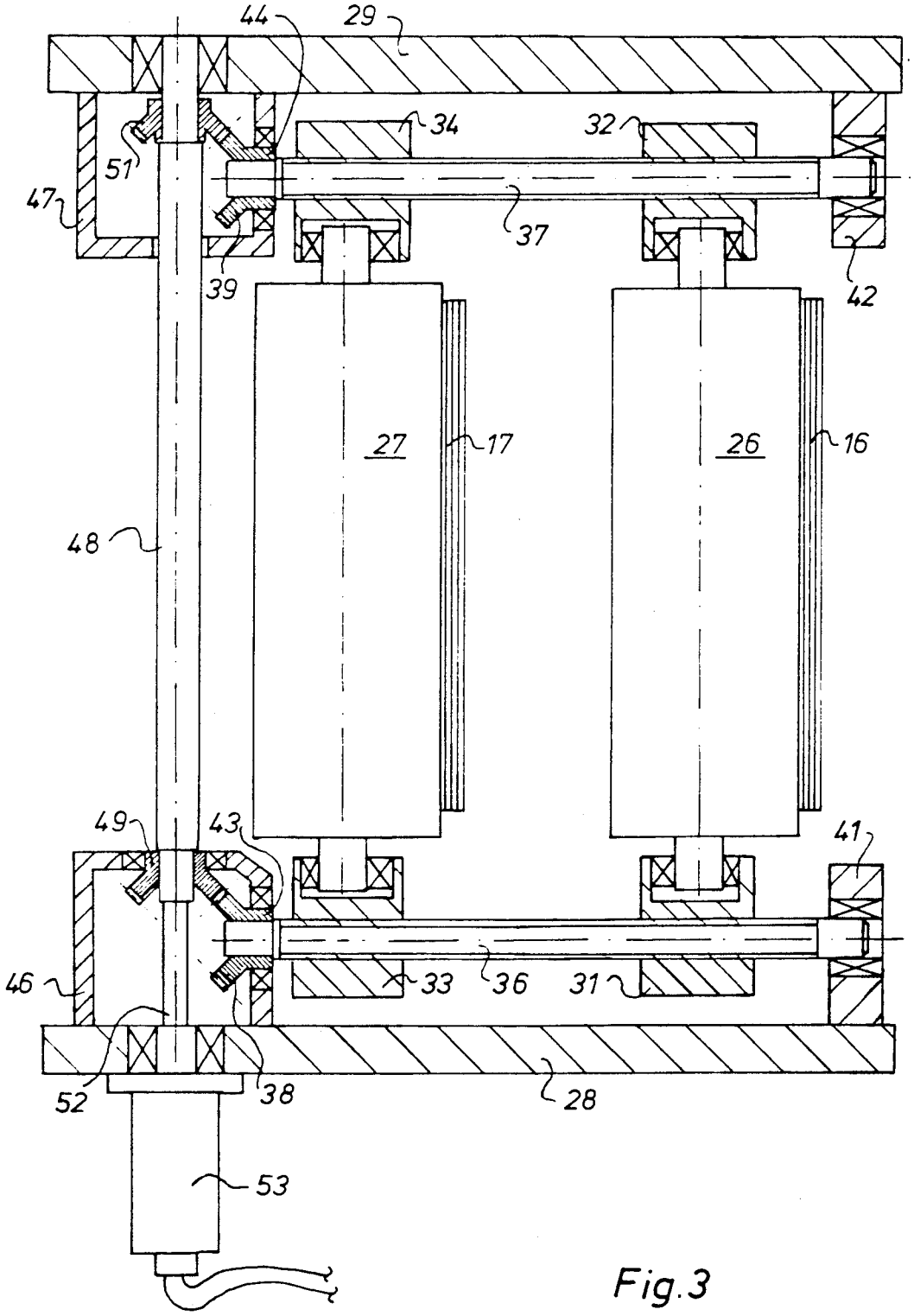
FIG. 3 is a top plan view of the strip cutting register assembly of the present invention and showing the shiftable strip register rollers useable to deflect the vertically traveling strip stacks in a horizontal direction.

As may be seen in FIG. 1, and as is also seen in FIG. 3, each of the stacks of strips 16 and 17 passes through a strip cutting register device 18. It is possible that there may be only one stack of strips. It is also possible that there could be more than two stacks of strips. In each situation there could be provided a shiftable strip cutting register device 18 for each strip.

Referring again primarily to FIG. 3, taken in conjunction with FIG. 1, the strip-cutting register device, generally at 18, includes upper strip-idler rollers 21 and 22, lower strip-idler rollers 23 and 24 and horizontally shiftable strip-register rollers 26 and 27 which are arranged between the upper strip-idler rollers 21 and 22, and the lower strip-idler rollers 23 and 24. Each of the strip-idler rollers 21, 22, 23 and 24 is rotatably supported in side frames 28 and 29 and each of these strip-idler rollers 21-24 is supported with its axis of rotation aligned generally horizontally and generally parallel to the width of the stacks of strips 16 and 17. The side frames 28 and 29 of the strip cutting register device 18 are securely attached and form-locked to the side frames of the folder assembly, generally at 14.

The shiftable strip register rollers 26 and 27, which are useable when there are two stacks of strips 16 and 17, are immediately effectively shifted together, or for short periods of time are shiftable one after the other and are then horizontally shifted together. In the embodiment of the invention as depicted in FIG. 3, each of the strip register rollers 26 and 27 is rotatably supported in bearing blocks 31 and 32, or 33 and 34 respectively. The bearing blocks 31 and 33, at the first ends of rollers 26 and 27, are supported by threaded boreholes on a first threaded spindle 36. The bearing blocks 32 and 34, at second ends of rollers 26 and 27, are supported by threaded boreholes on a second threaded spindle 37. A bevel gear 38 is wedged on a left end of the first thread spindle 36, and a bevel gear 39 is wedged on a left end of the second thread spindle 37. The right ends of the thread spindles 36 and 37 are rotatably supported in supports 41 and 42, respectively which are secured to the side frame walls 27 and 28. The bevel gears 38 and 39 are rotatably supported by their flanges 43 and 44 in a front support frame 46 and a rear support frame 47, respectively. A synchronous shaft 48 is rotatably supported in the support frames 46 and 47. Two shaft bevel gears 49 and 51 are wedged on shaft 48. Bevel gear 49 meshes with bevel gear 38 and bevel gear 51 meshes with bevel gear 39. An electromotor 53, which can reverse its direction of rotation, and which may be a step motor, is flanged on a front end 52 of the synchronous shaft 48. It would be possible to eliminate the synchronous shaft 48 and to provide a suitable electromotor for the shaft bevel gear 51. These two motors could be operated together, or could be operated separately if it were necessary to skew the stacks of sheets 16 and 17 on the shiftable strip register rollers 26 and 27.

The stack of strips 16 passes across or around the strip-idler rollers 21 and 23 and the right strip-register roller 26. The stack of strips 17 passes across or around the strip-idler rollers 22 and 24 and the left strip-register roller 27. As the strip-register rollers 26 and 27 are shifted together and are moveable synchronously horizontally, the travel of the strips 16 and 17 is elongated when shifting the strip-register rollers 26 and 27 to the right. When the strip-register rollers 26 and 27 are moved to the left, the path of travel of the strips 16 and 17 is shortened until the strips 16 and 17 do not touch the strip-register rollers 26 and 27 any longer.

After leaving the strip-cutting register device 18, the strips 16 and 17 pass through pull roller pairs 54, 56 and 57 and a guide roller pair 20 and are received by a strip-cross-cutting device 19 of a folder 58. The stacks of strips 16 and 17, which are laid on each other, are being pulled together by the pull roller 57.

Generally conventional cutting-marks reading heads 59 and 60 are placed adjacent each stack of strips 16 and 17 after the points of consolidation 10.1 and 10.2 of the strips 16 and 17, and before the strip cutting register device 18, as may be seen most clearly in FIG. 1. Each of these cutting marks reading heads 59 or 60 reads cutting register marks on its respective strip 16 or 17. If it is desired to move each shiftable strip register roller 26 and 27 individually, then it will be necessary to provide a separate cutting marks reading head 59 or 60 for each stack of strips 16 or 17. While the two shiftable strip register rollers 26 and 27 are depicted in FIG. 3 as being moveable together, it will be understood that each of these rollers 26 and 27 could be driven by separate motors through separate spindles so that each could be capable of independent movement.

Each reading head, or both reading heads 59 and 60 cooperate with a generally conventional electronic controlling and adjusting device 62 which controls the single or multiple electromotors 53 of the strip-cutting register device 18 in accordance with the strip-cutting register deviation. A synchronized impulse sender 63, which is mechanically connected with a knife cylinder of the strip-cross-cutting device 19, co-operates with the strip-cutting register controlling and adjusting device 62 in order to synchronize it. The reading heads 59 and 60 sense the position of the cutting register marks on the strips 16 and 17 and send this information to the adjusting device 62. Here the actual positions of the cutting register marks are sensed and are compared to a set or nominal value. Any deviation of the actual value from the set value will cause a signal to be sent to the motor 53 which will operate to rotate the synchronous shaft 48 and thus effect rotation of the threaded spindles 36 and 37. Movement of these spindles will move the shiftable strip register rollers 26 and 27 horizontally to either increase or decrease the distance of travel of the strips 16 and 17. This change in the distance of travel will compensate for variations in web tension and will maintain the strips 16 and 17 in accurate register with the strip cross-cutting device 19 and the folder 58.

A second group of cutting mark reading heads 64.1 to 64.8 can be positioned adjacent the individual strips 9.1 to 9.8 before these strips have reached the points of consolidation 10.1 and 10.2. These cutting marks reading heads 64.1 to 64.8 are electrically connected to a suitable part paper web controlling and adjusting device 65. A synchronized impulse sender 66 is operatively connected to this part paper web controlling and adjusting device 65. This impulse sender 66 is also connected with the knife cylinder of the strip cross-cutting device 19.

The strip cutting register device 18 of the present invention could also be used to control the position of the strip in response to web tension measurements. In this situation, the cutting mark read heads 59 and 60 could be replaced with web tension sensing devices. The readings from these web tension sensors would then be fed to a suitable adjusting device, such as is schematically depicted at 62. The actual web tension values would be compared to nominal values to generate an adjusting signal for motor or motors 53.

While a preferred embodiment of a method and apparatus for the reduction of paper waste in a web fed rotary printing machine in accordance with the present invention has been set forth fully and completely hereinabove, it will be apparent to one of skill in the art that a number of changes is, for example the type of printing press and, the number of part paper strips into which the paper web is slit, the type of strip cross-cutting device, the kind of folder used, and the like may be made without departing from the true spirit and scope of the present invention which is accordingly to be limited only by the following claims.

What is claimed is:

1. An apparatus for the reduction of paper waste in a web fed rotary printing machine, said apparatus comprising:

means for forming a printed paper web into a plurality of part paper web strips;

a plurality of paper web cutting register devices, each of said paper web cutting register devices engaging one of said part paper web strips before a point of strip consolidation;

a plurality of cutting mark reading heads, each of said cutting mark reading heads being positioned adjacent one of said part paper web strips before said point of strip consolidation;

means for forming said plurality of part paper web strips into at least a first stack of part paper web strips at said point of strip consolidation;

means for cross-cutting said at least first stack of part paper web strips into a plurality of signatures; and means for changing the distance of a path of travel of said stack of part paper web strips between said point of consolidation and said strip cross cutting means to effect proper registry of said stack of part paper web strips at said strip cross cutting means.

2. The apparatus of claim 1 wherein said means for changing the distance of said path of travel includes at least first and second spaced fixed rollers and a third shiftable roller positioned between said first and second spaced fixed rollers, said three rollers defining said path of travel of said stack of part paper web strips.

3. The apparatus of claim 1 wherein said plurality of part paper web strips is formed into at least first and second strips and further wherein each such strip passes over a shiftable roller between said point of strip consolidation and said cross-cutting device.

4. The apparatus of claim 1 further including a cutting register reading-head positioned adjacent said at least first stack of part paper web strips for sensing deviations in register of said stack of strips and a cutting register controlling and adjusting device for receiving an output from said cutting register reading head and for effecting said changing of said distance of said path of travel of said stack of strips and further connected to an impulse sender for effecting registry of said means for cross-cutting said at least first stack of strips.

5. A method for reducing paper waste in a web fed rotary printing machine, said method including the steps of:

forming a printed paper web into a plurality of part paper web strips;

passing each said part paper web strip through a separate paper web cutting register device positioned before a point of strip consolidation;

positioning a first cutting mark reading head adjacent each said part paper web strip before said point of strip consolidation;

assembling said plurality of part paper web strips into at least a first stack of strips at said point of strip consolidation;

directing said at least first stack of strips to a strip cross-cutting device;

passing said at least first stack of strips through a strip cutting register device positioned between said point of consolidation and said strip cross-cutting device;

varying a distance of travel of said at least first stack of strips through said strip cutting register device in response to deviations in registry of said at least first stack of strips from a nominal value; and providing means for sensing said deviation in registry of said at least first stack of strips and for effecting said variance of said distance of travel.

6. The method of claim 5 including sensing a deviation of tension of said at least first stack of strips and using said tension deviation for effecting said variance of said distance of travel.

7. The method of claim 5 including positioning at least a second cutting register marks reading head adjacent said at least first stack of strips and using readings from said at least second cutting register marks reading head to ascertain said deviations in registry of said at least first stack of strips.

* * * * *